US005588723A

United States Patent [19]

Sivin

[11] Patent Number: 5,588,723

[45] Date of Patent: Dec. 31, 1996

[54] ADJUSTABLE KITCHEN APPLIANCE GARAGE

[76] Inventor: B. Jerry Sivin, Parsons Pine Products, Inc P.O.Box 670, Ashland, Oreg. 97520

[21] Appl. No.: 387,256

[22] Filed: Feb. 13, 1995

[51] Int. Cl.[6] ..... A47B 45/00

[52] U.S. Cl. ..... 312/205; 312/238

[58] Field of Search ..... 312/140.1, 198, 312/204, 205, 238, 297

[56] References Cited

U.S. PATENT DOCUMENTS

| | | | |
|---|---|---|---|
| 2,318,921 | 5/1943 | Bullard | 312/238 |
| 2,500,037 | 3/1950 | Katz | 312/205 |
| 2,632,682 | 3/1953 | Corrigan | 312/205 |
| 3,926,486 | 12/1975 | Sasnett | 312/198 |
| 4,223,967 | 9/1980 | Royer | 312/205 |
| 4,441,768 | 4/1984 | Clarkson | 312/297 |

*Primary Examiner*—James R. Brittain
*Assistant Examiner*—Gerald A. Anderson

[57] ABSTRACT

The present invention relates to a adjustable kitchen appliance garage which contains kitchen small gadgets and appliance within. The unit has a retractable door to cover the gadgets and appliances giving an aesthetic appearance in the kitchen. The unit is also adjustable and has an fixedly adjustable shroud located on the top of the unit being slightly larger than the bottom unit housing permitting sliding thereover. The adjustability is a function of the distance from the kitchen counter top to the bottom of the kitchen cabinets. In addition, the shroud and the bottom unit both have corresponding angular corner pieces which may concurrently form obtuse angles such that the unit can be positioned in a corner of a kitchen as well as on a kitchen wall.

16 Claims, 2 Drawing Sheets

ADJUSTABLE KITCHEN APPLIANCE GARAGE

BACKGROUND OF THE INVENTION

1. Field of the Invention

The present invention relates generally to an adjustable kitchen storage device. More particularly, the present invention relates to an adjustable kitchen appliance garage for storing and hiding small kitchen appliances and gadgets on a counter.

2. Description of the Prior Art

Consumers today often have a large number of small household appliances and/or gadgets in their kitchens. Often, the draw and cabinet space in a kitchen does not have the capacity to store all the small appliances and gadgets a consumer owns. This often forces the consumer to leave these gadgets or appliances exposed on a counter top, which can have a number of undesirable results. First, the overall appearance of a kitchen is made to look sloppy and unorganized when gadgets are stored on the counters. Second, the appliances and gadgets can be damaged due to exposure to varying environmental factors in a kitchen such as light and detergents. Such environmental factors could include moisture, food particles, dust or even small children. In addition, there is a safety hazard concerning small children utilizing kitchen gadgets and appliances that this present invention eliminates. Therefore, there is a need for a kitchen appliance garage that can neatly store and hide small kitchen appliances and gadgets left on a counter top.

There have been a number of kitchen appliance garages on the market for years as custom made products. These devices are square storage bins with doors that are placed over the appliances and gadgets left on counter tops. These devices are custom made to integrally fit between the counter top and upper cabinets in a kitchen. The reason why these devices needed to be custom made is because in there is no standard height between the counter top and the upper cabinets in kitchens. This height can vary widely from kitchen to kitchen. The custom nature of these devices tend to make them expensive for the simple purpose they serve as well as time consuming to manufacture and order.

In addition, there are also mass produced kitchen appliance garages available on the market today. These devices are of a fixed height and often have to be cut to fit integrally between a consumer's counter and upper cabinets. Cutting these devices to size is often very difficult and beyond an average consumers ability therefore, requiring the consumer to hire expensive cabinet makers to perform the necessary work.

The present invention solves the above problems by providing an adjustable kitchen appliance garage that can be readily and economically adjusted to varying heights by the consumers themselves.

Numerous innovations for kitchen counter storage devices have been provided in the prior art that are adapted to be used. Even though these innovations may be suitable for the specific individual purposes to which they address, they would not be suitable for the purposes of the present invention as heretofore described.

SUMMARY OF THE INVENTION

In accordance with the present invention, an adjustable kitchen appliance garage is constructed from a housing and shroud. The shroud is capable of being attached to different vertical positions on the top portion of the housing to vary the height of the kitchen appliance garage. The housing consists of two walls spaced at a distance from each other, which are connected by a cross member. The two walls and cross member define a storage space that can be exposed and covered by retractable door. The retractable door is mounted to the inside of the housing.

Broadly considered, the invention comprises an adjustable kitchen appliance garage that has an adjustable height. The kitchen appliance garage can be installed by placing it on a counter top in a kitchen. The height of the garage can be adjusted so that it completely fills up the space between the counter top and above counter tops. Thus, the adjustable height feature allows the garage to fit integrally between the counter top and the above cabinets. Once installed, the storage space can be accessed by the retractable door.

Accordingly, it is an object of the present invention to provide an adjustable kitchen appliance garage for storing small kitchen appliances or gadgets.

More particularly, it is an object of the present invention to provide a kitchen appliances garage with an adjustable height.

In keeping with these objects, and with others which will become apparent hereinafter, one feature of the present invention resides, briefly stated, in that the adjustable kitchen appliance can fit integrally in the space between a counter top and above cabinets in any kitchen.

When the adjustable kitchen appliance garage is designed in accordance with the present invention, it will readily and economically fit integrally between above the counter top and below the cabinets in any kitchen.

In accordance with another feature of the present invention, the adjustable appliance garage can give the kitchen counter a neat and organized look.

Another feature of the present invention is that after installation it provides the kitchen with a decorative look.

Yet another feature of the present invention is that can be installed using just easily attached mechanism such as screws.

Still another feature of the present invention is that the adjustable kitchen appliance garage also has an adjustable depth.

Yet still another feature of the present invention is that the shroud may have a serf adjusting means whereby when the kitchen appliance garage is placed underneath the kitchen cabinets and on top of the kitchen counter and the shroud is independently attached to the housing allowing the housing to move in a downward direction when pressure is asserted and then returning to an upward position resting on the underside of the kitchen cabinets.

Still yet another feature of the present invention is that it is capable of easy disassembly and reassembly for shipping purposes and mail order sales.

Another feature of the present invention is that a retracting door is mounted on tracks which facilitate the retraction and extension of the door.

Yet another feature of the present invention is that the retracting door is composed of a plurality of individual slats interconnected with a hinge-like means which may be typical hinges, piano hinges and/or specialized hinges such as cloth, straps or tape forming a hinge-like means.

Still another feature of the present invention is that the front, sides and/or shroud are interchangeable to match the color and decor of the consumers individual kitchen.

Yet still another feature of the present invention is that by adjusting the angle of the left and right walls to and obtuse angle configures the present invention into being adapted to a corner situation on top of a kitchen cabinet.

Still yet another feature of the present invention is that hinge like means may be attached to the left and right corners of the shroud and simultaneously a hinge like means may be attached to the left and right corners of the housing allows the single unit to become quickly and easily configured from a straight unit placed on a straight wall having right angular corners into a unit capable of fitting and adjusting into a corner unit having obtuse angular corners.

Another feature of the present invention is that a secondary door track may be mounted on a top piece spanning the distance between the left and right shroud, thus, permitting a single unit with retracting doors to be utilized for both the straight and corner unit.

Yet another feature of the present invention is that the retractable door is retractable by a self rolling means powered by springs and/or other retracting means.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawing(s).

BRIEF LIST OF REFERENCE NUMERALS UTILIZED IN THE DRAWING

FIRST PREFERRED EMBODIMENT

10—first embodiment adjustable kitchen appliance garage 10
12A—first embodiment left wall 12A
12B—first embodiment right wall 12B
14A—first embodiment left lip 14A
14B—first embodiment right lip 14B
15—first embodiment cross member 15
16A—first embodiment left wall adapter 16A
16B—first embodiment right wall adapter 16B
17—first embodiment retractable door roller 17
18—first embodiment shroud 18
18A—first embodiment left shroud member 18A
18C—first embodiment middle shroud member 18C
19—first embodiment retractable door roller bracket 19
20A—first embodiment left shroud joint 20A
20B—first embodiment right shroud joint 20B
22—first embodiment retractable door 22
22A—first embodiment door slats 22A
22B—first embodiment door hinges 22B
24A—first embodiment left door track 24A
26A—first embodiment left attachment means receptacle 26A
27A—first embodiment left attachment means 27A
28—first embodiment storage space 28
30—kitchen cabinet 30
32—kitchen wall 32
34—kitchen wall molding 34
36—kitchen counter top 36

SECOND PREFERRED EMBODIMENT

110—second embodiment adjustable kitchen appliance garage 110
112A—second embodiment left wall 112A
112B—second embodiment right wall 112B
114A—second embodiment left lip 114A
114B—second embodiment right lip 114B
115—second embodiment cross member 115
116A—second embodiment left wall adapter 116A
116B—second embodiment right wall adapter 116B
118—second embodiment shroud 118
118A—second embodiment left shroud member 118A
118B—second embodiment right shroud member 118B
118C—second embodiment middle shroud member 118C
120A—second embodiment left shroud joint 120A
120B—second embodiment right shroud joint 120B
122—second embodiment retractable door 122
122A—second embodiment door slats 122A
122B—second embodiment door hinge 122B
124A—second embodiment left door track 124A
126A—second embodiment left attachment means receptacle 126A
127A—second embodiment attachment means 127A
128 —second embodiment storage space 128

THIRD EMBODIMENT

310—third embodiment adjustable kitchen appliance garage 310
312A—third embodiment left wall 312A
312B—third embodiment right wall 312B
314A—third embodiment left lip 314A
314B—third embodiment right lip 314B
315—third embodiment cross member 315
316A—third embodiment left wall adapter 316A
316B—second embodiment right wall adapter 316B
318—third embodiment shroud 318
318A—third embodiment left shroud member 318A
318B—third embodiment right shroud member 318B
318C—third embodiment middle shroud member 318C
320A—third embodiment left shroud joint 320A
320B—third embodiment right shroud joint 320B
338B—third embodiment attachment means receptacle 338B
340B—right springs 340B
342B—right bent brackets 342B
344A—left wall hinge 344A
344B—right wall hinge 344B
346A—left shroud hinge 346A
346B—right shroud hinge 346B

DETAILED DESCRIPTION OF THE PREFERRED EMBODIMENT

Figure 1:
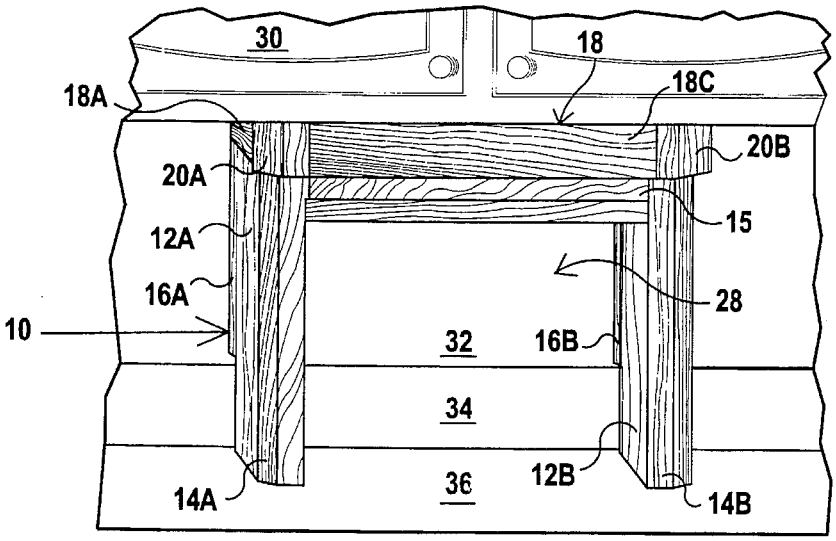
FIG. 1 a front perspective view of the first preferred embodiment of the kitchen appliance garage having there tractable door in an upward position exposing the storage space therein.

Firstly, referring to FIG.1 which is a front perspective view of the first preferred embodiment of the kitchen appliance garage 10 having the first embodiment retractable door 22 in an upward position exposing the first embodiment storage space 28 therein exhibiting the following features: first embodiment left wall 12A; first embodiment right wall 12B; first embodiment left lip 14A; first embodiment right lip 14B; first embodiment cross member 15; first embodiment left wall adapter 16A; first embodiment right wall adapter 16B; first embodiment shroud 18; first embodiment left shroud member 18A; first embodiment middle shroud member 18C; first embodiment left shroud joint 20A; first embodiment right shroud joint 20B; first embodiment storage space 28; kitchen cabinet 30; kitchen wall 32; kitchen wall molding 34; and kitchen counter top 36.

The first embodiment left wall 12A is fixedly connected at a front longitudinal surface to the first embodiment left lip 14A and fixedly connected at a rear longitudinal surface to the first embodiment left wall adapter 16A which is optional and removable if or if not the kitchen has kitchen wall molding 34 functioning to permit flush mounting of the first preferred embodiment of the kitchen appliance garage 10 against to wall resulting in greater stability than free standing structures.

The first embodiment left lip 14A is fixedly connected at a top distal end to the first embodiment cross member 15.The first embodiment left lip 14A functions to connect the first embodiment left wall 12A to the first embodiment cross member 15 and also functions to give an aesthetic appearance hiding the first embodiment left door track 24A behind.

The first embodiment retractable door roller bracket 19 is disposed at a top portion of the first embodiment left lip 14A. The first embodiment cross member 15 is fixedly connected at opposite distal ends to the first embodiment left lip 14A and the first embodiment right lip 14B functions to rigidly attach the right and left side of the first preferred embodiment of the kitchen appliance garage 10.

The first embodiment right lip 14B is fixedly connected at a top distal end to the first embodiment cross member 15. The first embodiment right lip 14B functions to connect the first embodiment right wall 12B to the first embodiment cross member 15 and also functions to give an aesthetic appearance hiding the first embodiment right door track (not shown) behind.

The first embodiment right wall 12B is fixedly connected at a front longitudinal surface to the first embodiment right lip 14B and fixedly connected at a rear longitudinal surface to the first embodiment right wall adapter 16B which is optional and removable if or if not the kitchen has kitchen wall molding 34 functioning to permit flush mounting of the first preferred embodiment of the kitchen appliance garage 10 against to wall resulting in greater stability than free standing structures.

The first embodiment shroud 18 is attached at several locations to the first embodiment left lip 14A and the first embodiment right lip 14B by first embodiment left attachment means receptacle 26A positioned therein and first embodiment left attachment means 27A securely fastened there through. A plurality of embodiment left attachment means receptacles 26A a present allowing the first embodiment shroud 18 to be raised and lowered easily corresponding to the distance between the kitchen cabinet 30 and kitchen counter top 36.

The first embodiment shroud 18 is composed of the first embodiment left shroud member 18A which is fixedly connected to the first embodiment middle shroud member 18C by the first embodiment left shroud joint 20A which forms a right angle between the first embodiment left side shroud member 18A and the first embodiment middle shroud member 18C. The first embodiment right shroud joint 20B fixedly connects the first embodiment middle shroud member 18C to the first embodiment right side shroud member (not shown).

The first embodiment storage space 28 is present within the first preferred embodiment of the kitchen appliance garage 10 enabling a user to store kitchen gadgets and appliances therein and hidden by virtue of lowering the first embodiment retractable door 22.

Figure 1A:
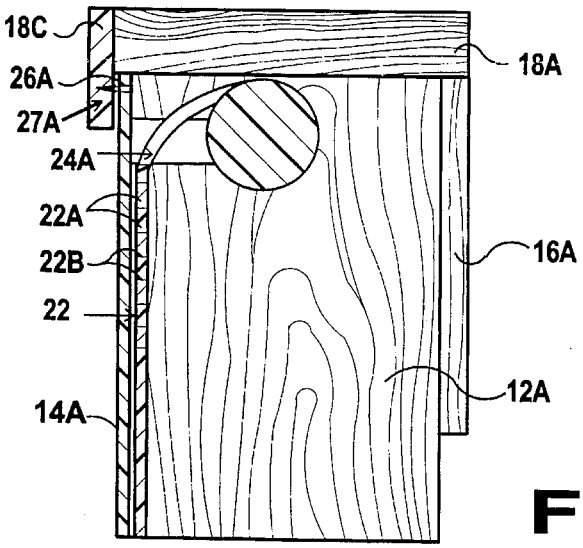
FIG. 1A is a left cross sectional view of the first preferred embodiment of the adjustable kitchen appliance garage along the 2A axis of FIG.4.
Figure 4:
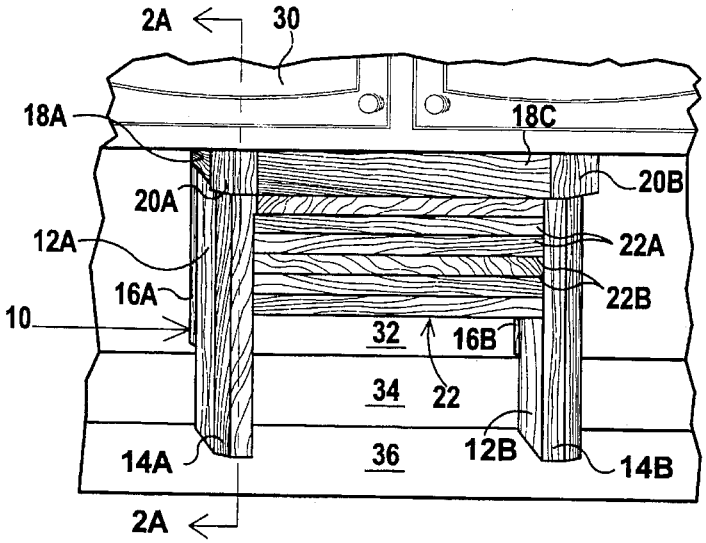
FIG. 4 is a front view of the first preferred embodiment with the retractable door in a half-way down position.

Now referring to FIG.1A which is a left cross sectional view of the first preferred embodiment 10 of the adjustable kitchen appliance garage along the 3A axis of FIG.4 exhibiting the following features: first embodiment left wall 12A; first embodiment left lip 14A; first embodiment left wall adapter 16A; first embodiment roller means 17; first embodiment left side shroud member 18A; first embodiment middle shroud member 18C; first embodiment roller attaching means 19A; first embodiment left shroud joint 20A; first embodiment retractable door 22; first embodiment door slats 22A; first embodiment door hinges 22B; first embodiment left door slot 24A; first embodiment left attachment means receptacle 26A; first embodiment left attachment means 27A; first embodiment storage space 28; kitchen wall 32; and kitchen wall molding 34.

The first embodiment left attachment means receptacle 26A is located in the upper portion of the first embodiment left lip 14A as shown. The first embodiment left attachment means 27A passes through the first embodiment left attachment means receptacle 26A and is permanently attached to the first embodiment middle shroud member 18C. This keeps the first embodiment middle shroud member 18C securely flush to the cross member 15 and the first embodiment left side shroud member 18A to the first embodiment left parallel wall 12A.

The first embodiment left door slot 24A is contained within and runs the vertical length of the first embodiment left lip 14A. The first embodiment left door slot 24A guides the first embodiment retractable door 22 as it is rolled up or down. The left edge of the first embodiment retractable door 22 is located within the first embodiment left door slot 24A. The top edge of the first embodiment retractable door 22 is attached to the first embodiment roller means 17.

The first embodiment roller means 17 winds or unwinds the retractable door 22 when the retractable door 22 is moved up or down. The left edge of the first embodiment roller means 17 is fastened to one end of the first embodiment roller attaching means 19A. The other end of first embodiment roller attaching means 19A is mounted to the inner surface of the first embodiment left lip 14A. The first embodiment roller attaching means 19A positions the first embodiment roller means 17 adjacent to the retractable door 22.

The right side of the first embodiment retractable door 22 and the first embodiment roller means 17 assembly is a duplicate of the left. The first embodiment retractable door 22 is constructed of a plurality of door hinges 22B that space and interconnect a plurality of first embodiment door slats 22A.

The first embodiment door slats 22A can be fabricated from a variety of materials such as wood or plastic. The first embodiment door hinges can be of a variety of types such as regular, piano, tape or plastic hinges.

When the first embodiment retractable door 22 is pulled upward, the first embodiment retractable door 22 will slide upward within the first embodiment left door slot 24A and the first embodiment door slot (not shown), and at the same time the first retractable door 22 will wind around the first embodiment roller means 17. When the retractable door is pulled downward the first embodiment roller means 17 will unwind the retractable door,and allow the retractable door 22 to slide downward the first embodiment left door slot 24A and the first embodiment right door slot (not shown).

Figure 2:
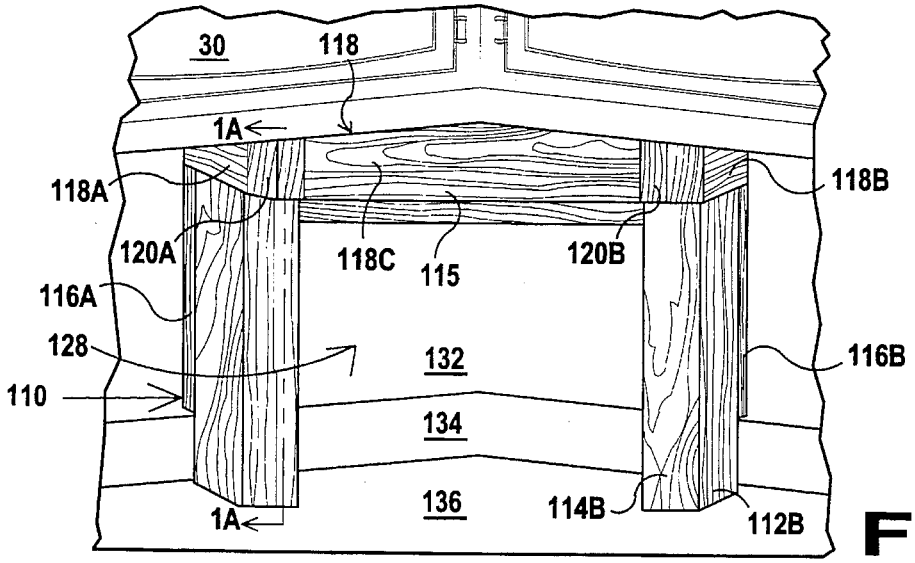
FIG. 2 is a front perspective view of the second preferred embodiment of the kitchen appliance garage exhibiting obtusely angled left wall and right wall having there tractable door in an upward position exposing the storage space.

Now referring to FIG.2 which is a front perspective view of the second preferred embodiment of the kitchen appliance garage 110 having the second embodiment retractable door 122 in an upward position exposing the second embodiment storage space 128 therein exhibiting the following features: second embodiment left wall 112A; second embodiment right wall 112B; second embodiment left lip 114A; second embodiment right lip 114B; second embodiment cross member 115; second embodiment left wall adapter 116A; second embodiment right wall adapter 116B; second embodiment shroud 18; second embodiment left shroud member 118A; second embodiment right shroud member 118B; second embodiment middle shroud member 118C; second embodiment left shroud joint 120A; second embodiment right shroud joint 120B; second embodiment storage space 128; kitchen cabinet 130; kitchen wall 132; kitchen wall molding 134; and kitchen counter top 136.

The second preferred embodiment of the kitchen appliance garage 110 is constructed in the same manner as the first preferred embodiment of the kitchen appliance garage 10 except for the second embodiment left wall 112A and the second embodiment right wall 112B are connected forming obtuse angles with the second embodiment left lip 114A and the second embodiment right lip 114B, respectively. The second embodiment left wall 112A and the second embodiment right wall 112B are configured in this manner to increase the first embodiment storage space 128.

The second embodiment shroud 118 is configured so that the second embodiment left shroud member 118A and the second embodiment right shroud member 118B form obtuse angles with the second embodiment middle shroud member 118C when assembled. The second embodiment left shroud joint 120A attaches the front end of the second embodiment left shroud member 118A to the left end of the second embodiment middle shroud member 118C forming an obtuse angle. The second embodiment right shroud joint 120B attaches the front end of the second embodiment right shroud member 118B to the right end of the second embodiment middle shroud member 118C forming an obtuse angle.

The second embodiment middle shroud member 118C attaches to the second embodiment cross member 115 so that the inner surfaces of the second embodiment left shroud member 118A and the second embodiment right shroud member 118B contact flush the outer surfaces of the second embodiment left wall 112A and the second embodiment right wall 112B respectively.

As shown in FIG.2, the second preferred embodiment of the kitchen appliance garage 110 is adapted to be a corner unit. The second preferred embodiment also fits integrally between the kitchen cabinet 130 and the kitchen counter top 136. The second embodiment left wall 112A and second embodiment right wall 112B slant outward increasing the second embodiment storage space 128. The second embodiment storage space 128 is increased to compensate for the lost space due to the second embodiment being a corner unit.

Figure 2A:
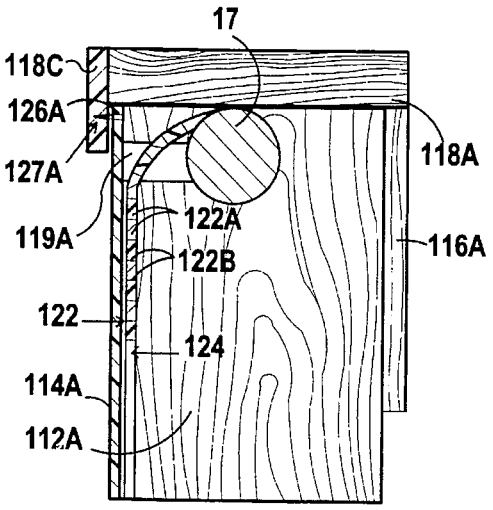
FIG. 2A is a left cross sectional view of the second preferred embodiment of the adjustable kitchen appliance garage along the 2A axis of FIG.4 exhibiting the retracting door in a halfway upward position being rolled on the door roller.

Now referring to FIG.2A which is a left cross sectional view of the second preferred embodiment 110 of the adjustable kitchen appliance garage along the 2A axis of FIG.4 exhibiting the following features: the second embodiment left wall 112A; second embodiment left lip 114A; second embodiment left wall adapter 116A; first embodiment roller means 117; second embodiment left side shroud member 118A; second embodiment middle shroud member 118C; second embodiment roller attaching means 119A; second embodiment left shroud joint 120A; second embodiment retractable door 122; second embodiment door slats 122A; second embodiment door hinges 122B; second embodiment left door slot 124A; second embodiment left attachment means receptacle 126A; second embodiment left attachment means 127A; second embodiment storage space 128; kitchen wall 132; and kitchen wall molding 134.

The second embodiment left attachment means receptacle 126A is located in the upper portion of the second embodiment left lip 114A as shown. The second embodiment left attachment means 127A passes through the second embodiment left attachment means receptacle 126A and is permanently attached to the second embodiment middle shroud member 118C. This keeps the second embodiment middle shroud member 118C securely flush to the second embodiment cross member 15 and the second embodiment left side shroud member 118A to the second embodiment left parallel wall 112A.

The second embodiment left door slot 124A is contained within and runs the vertical length of the second embodiment left lip 114A. The second embodiment left door slot 124A guides the second embodiment retractable door 122 as it is rolled up or down. The left edge of the second embodiment retractable door 122 is located within the second embodiment left door slot 124A. The top edge of the second embodiment retractable door 122 is attached to the second embodiment roller means 117.

The second embodiment roller means 117 winds or unwinds the second embodiment retractable door 122 when the second embodiment retractable door 122 is moved up or down. The left edge of the second embodiment roller means 117 is fastened to one end of the second embodiment roller attaching means 19A. The other end of the second embodiment roller attaching means 119A is mounted to the inner surface of the second embodiment left lip 114A.

The second embodiment roller attaching means 119A positions the second embodiment roller means 117 adjacent to the second embodiment retractable door 122. The right side of the second embodiment retractable door 122 and the second embodiment roller means 117 assembly is a duplicate of the left. The second embodiment retractable door 122 is constructed of a plurality of second embodiment door hinges 122B that space and interconnect a plurality of second embodiment door slats 122A.

The second embodiment door slats 122A can be fabricated from a variety of materials such as wood or plastic. The second embodiment door hinges can be of a variety of types such as regular, piano, tape or plastic hinges.

When the second embodiment retractable door 122 is pulled upward, the second embodiment retractable door 122 will slide upward within the second embodiment left door slot 124A and the second embodiment door slot (not shown), and at the same time the second embodiment retractable door 122 will wind around the second embodiment roller means 117.

When the second embodiment retractable door 122 is pulled downward the first embodiment roller means 117 will unwind the retractable door, and allow the second embodiment retractable door 122 to slide downward the second embodiment left door slot 124A and the second embodiment right door slot (not shown).

Figure 3:
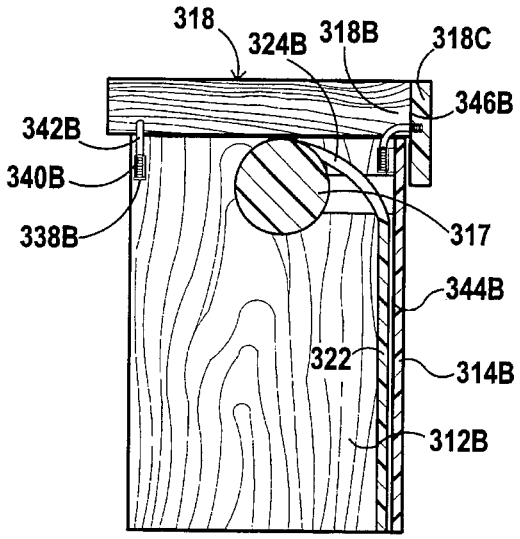
FIG. 3 is a right cross sectional view of the third preferred embodiment of the adjustable kitchen appliance garage along the 3 axis of FIG. 3A exhibiting right wall being adjustably connected to the right shroud member and the third preferred embodiment lip and the third preferred embodiment middle shroud member.
Figure 3A:
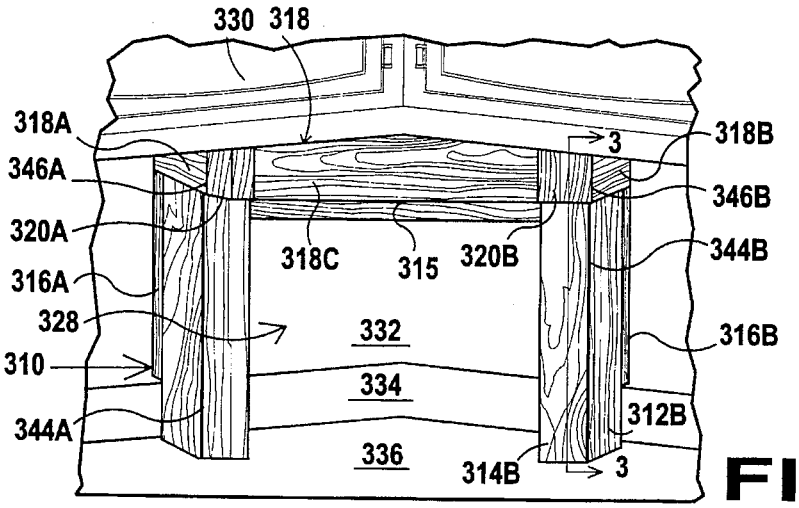
FIG. 3A is a front perspective view of the third preferred embodiment of the adjustable kitchen appliance garage exhibiting a rotatably attached left wall and a rotatably attached right wall having the retractable door in an upward position exposing the storage space.

Now referring to FIG.3 which is a right cross sectional view of the third preferred embodiment of the adjustable kitchen appliance garage 310 along the 3 axis of FIG.3A exhibiting the third preferred embodiment right wall 312B being adjustably connected to the third preferred embodiment right shroud member 318B and the third preferred embodiment right lip 314B and the third preferred embodiment middle shroud member 318C exhibiting the following features: third embodiment adjustable kitchen appliance garage 310; third embodiment right wall 312B; third embodiment shroud 318; third embodiment right shroud member 318B; third embodiment middle shroud member 318C; third embodiment attachment means receptacle 338B; right springs 340B; right bent brackets 342B; right wall hinge 344B; right shroud hinge 346B.

A third embodiment attachment means receptacle 338B is located on the front and back top edge of the third embodiment right wall 312B. The third embodiment attachment means receptacle 338B are bores drilled through the front and top edge of the third embodiment right wall 312B.

The bottom end of each of the right springs 340B is placed within each of the third embodiment attachment means receptacle 338B. The top end of each of the springs is attached to one end of the right bent brackets 342B. The second end of each of the right bent brackets are pointed and threaded for attachment to the third embodiment shroud 318. The second end of the front right bent bracket 342B and the rear right bent bracket are attached to the inner surface of the third embodiment middle shroud member 318C and the third embodiment right shroud member 318B, respectively.

Applying a downward force to the top surface of the third embodiment shroud 318 will cause both of the third embodiment right brackets 342B to move downward compressing the third embodiment right springs 340B into the third embodiment attachment means receptacle 338B which will decrease the overall height of the third embodiment adjustable kitchen appliance garage 310.

Removing the downward force will allow the third embodiment right springs 340B to expand out of the third embodiment attachment means receptacle 338B pushing on the third embodiment right brackets 342B, which forces the third embodiment shroud 21 to move upward increasing the overall height of the third embodiment adjustable kitchen appliance garage 310. The third embodiment left wall (not shown) also has two similar spring-bracket assemblies attached to the third embodiment shroud 318 that compress and expand in a the same way.

These four spring bracket assemblies allow a user to vary the overall height of the third embodiment adjustable kitchen appliance garage 310 by applying a force to the top surface of the third embodiment shroud 318.

Referring to FIG. 3A, which is a front perspective view of the third preferred embodiment of the adjustable kitchen appliance garage 310 exhibiting a rotatably attached third embodiment left wall 312A and a rotatably attached third embodiment right wall 312B having the third embodiment retractable door 322 in an upward position exposing the storage space exhibiting the following features: third embodiment left wall 312A; third embodiment right wall 312B; third embodiment left lip 314A; third embodiment right lip 314B; third embodiment shroud 318; third embodiment left shroud member 318A; third embodiment right shroud member 318B; third embodiment middle shroud member 318C; third embodiment left shroud joint 320A; third embodiment right shroud joint 320B; left wall hinge 344A; right wall hinge 344B; left shroud hinge 346A; right shroud hinge 346B. The third embodiment adjustable appliance garage is constructed similar to the first embodiment except for the third embodiment left wall 312A, the third embodiment right wall 312B wall and the third embodiment shroud 318 assembly.

The left wall hinge 344A rotatably attaches the third embodiment left wall 312A to the third embodiment left lip 314A. The left wall hinge 344A allows the third embodiment left wall 312A to be rotated from a perpendicular position with the third embodiment left lip 314A to an obtuse position with the third embodiment left lip 314A. The right wall hinge 344B also rotatably attaches the third embodiment right wall 312B to the third embodiment right lip 314B. The right wall hinge 344B also allows the third embodiment right wall 312B to be rotated from a perpendicular position with the third embodiment right lip 314B to an obtuse position with the third embodiment right lip 314B. The third embodiment left wall 312A and the third embodiment right wall 312B in the perpendicular position allows them to conform to a straight rear wall, while in the obtuse position the third embodiment left wall 312A and the third embodiment right wall 312B can conform to a corner rear wall. This allows the third embodiment adjustable kitchen garage 310 to be converted from a straight wall unit similar to the first embodiment to a corner wall unit similar to the second embodiment.

The third embodiment left shroud joint 320A and the third embodiment right shroud joint 320B are fabricated to have a left shroud hinge 346A and a right shroud hinge 346B. This allows the third embodiment left shroud joint 320A and the third embodiment right shroud joint 320B to be rotated from a perpendicular position to a an obtuse position. This in turn allows both the third embodiment left shroud member 318A and the third embodiment right shroud member 318B to be rotated from a perpendicular position with the third embodiment middle shroud member 318C to an obtuse position with the third embodiment middle shroud member 318C when the third embodiment shroud 318 is assembled. Thus, the third embodiment shroud 318 can be adjusted to conform to the third embodiment adjustable appliance garage 310 when it is in either the straight wall configuration or the corner wall configuration.

The third embodiment adjustable appliance garage 310 is installed similar to the first embodiment except that the user must place the third embodiment left wall 312A and the third embodiment right wall 312B of the third embodiment adjustable kitchen appliance garage in either a perpendicular or obtuse position. Then the user must place the third embodiment shroud 318 into its perpendicular position or acute position to conform to the third embodiment left wall 312A and the third embodiment right wall 312B.

While the invention has been illustrated and described as embodied in an adjustable kitchen appliance garage, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. A variable height storage device for placement between a lower surface, an upper surface and a rear surface, comprising:

a) a left wall having a left wall front portion with a left wall front portion lip extending therefrom;

b) a right wall having a right wall front portion with a right wall front portion lip extending therefrom, the right wall being displaced a distance from the left wall and defining a storage space therebetween;

c) a cross member connecting the left wall to the right wall and having a left end and a right end, the left end of the cross member being attached to the left wall front portion lip and the right end of the cross member being attached to the right wall front portion lip;

d) a retractable door disposed within the left wall front portion lip and the right wall front portion lip capable of moving between a closed position covering the storage space and an open position; and e) a shroud removably mounted to the cross member and joining the variable height storage device to the upper surface so that the space between the variable height storage device and the upper surface is aesthetically enclosed while providing support for the mounted variable height storage device.

2. The variable height storage device as defined in claim 1, which further comprises:

a) a left hinge for pivotly attaching the left wall front portion to the left wall front portion lip functioning to move the left wall front portion and the left wall front portion lip into an angular position in relation to one another; and b) a right hinge for pivotly attaching the right wall front portion to the right wall front portion lip functioning to move the right wall front portion and the right wall front portion lip into an angular position in relation to one another.

3. The variable height storage device as defined in claim 2, wherein the angular position being selected from a group of angles consisting of obtuse, acute and perpendicular.

4. The variable height storage device as defined in claim 1, which further comprises:

a) the left wall having a left wall rear portion and the right wall having a right wall rear portion; and b) a left wall adapter removably attached to the left rear wall portion and a right wall adapter removably attached to the right rear wall portion for joining the variable height storage device to the rear surface aesthetically enclosing the space between the variable height storage device and the rear surface.

5. The device as defined in claim 4, which further comprises a rolling means contained within the storage space for storing the retractable door when the retractable door is in the closed position.

6. The device as defined in claim 5, wherein the shroud is removably attached by a fastening means selected from a group consisting of screw, nail, pin, semi-permanent adhesive and staple.

7. The device as defined in claim 1, wherein the left wall, the right wall, the retractable door, and the shroud being constructed from a group of materials consisting of wood, fiberglass, epoxy, plastic, plasic composites, metal, metal alloys, and carbon-graphite.

8. The device as defined in claim 1, wherein the left wall front portion lip and the right wall front portion lip each having a slot-like track means functioning to guide the retractable door onto and therefrom the roller means.

9. A variable height storage device for placement between a lower surface and an upper surface, comprising:

a) a left wall having a left wall front portion with a left wall front portion lip extending therefrom;

b) a right wall having a right wall front portion with a right wall front portion lip extending therefrom, the right wall being displaced a distance from the left wall and defining a storage space therebetween;

c) a cross member connecting the left wall to the right wall and having a left end and a right end, the left end of the cross member being attached to the left wall front portion lip and the right end of the cross member being attached to the right wall front portion lip;

d) a retractable door disposed within the left wall front portion lip and the right wall front portion lip capable of moving between a closed position covering the storage space and an open position;

e) a shroud removably mounted to the cross member and joining the variable height storage device to the upper surface; and f) means for movably attaching the shroud to the cross member and the left wall and the right wall at a variety of positions aesthetically enclosing the space between the variable height storage device and the upper surface while providing support for the mounted variable height storage device.

10. The variable height storage device as defined in claim 9, which further comprises:

a) a left hinge for pivotly attaching the left wall front portion to the left wall front portion lip functioning to move the left wall front portion and the left wall front portion lip into an angular position in relation to one another; and b) a right hinge for pivotly attaching the right wall front portion to the right wall front portion lip functioning to move the right wall front portion and the right wall front portion lip into an angular position in relation to one another.

11. The variable height storage device as defined in claim 10, wherein the angular position being selected from a group of angles consisting of obtuse, acute and perpendicular.

12. The device as defined in claim 9, which further comprises:

a) the left wall having a left wall rear portion and right wall having a right wall rear portion; and b) a left wall adapter removably attached to the left rear wall portion and a right wall adapter removably attached to the right rear wall portion for joining the variable height storage device to the rear surface so that the space between the variable height storage device and the rear surface is aesthetically enclosed.

13. The device as defined in claim 9, which further comprises a rolling means contained within the storage space for storing the retractable door when the retractable door is in the closed position.

14. The device as defined in claim 9, wherein the removable attaching means are selected from a group consisting of springs, pneumatic means, and hydraulic means.

15. The device as defined in claim 9, wherein the left wall, the right wall, the retractable door, and the shroud being constructed from a group of materials consisting of wood, fiberglass, epoxy, plactic, plasic composites, metal, metal alloys, and carbon-graphite.

16. The device as defined in claim 9, wherein the left wall front portion lip and the right wall front portion lip each having a slot-like track means functioning to guide the retractable door onto and therefrom the roller means.

* * * * *